United States Patent [19]

Honda

[11] Patent Number: 4,583,844

[45] Date of Patent: Apr. 22, 1986

[54] IMAGE RECORDING APPARATUS WITH SEPARABLE UPPER AND LOWER SECTIONS AND DISPLACEABLE PAPER FEED UNIT

[75] Inventor: Hiroyuki Honda, Hachioji, Japan

[73] Assignee: Konishiroku Photo Industry Co., Ltd., Tokyo, Japan

[21] Appl. No.: 648,643

[22] Filed: Sep. 7, 1984

[30] Foreign Application Priority Data

| | | | |
|---|---|---|---|
| Sep. 19, 1983 | [JP] | Japan | 58-172654 |
| Sep. 19, 1983 | [JP] | Japan | 58-172655 |
| Sep. 19, 1983 | [JP] | Japan | 58-172657 |
| Sep. 27, 1983 | [JP] | Japan | 58-149970[U] |
| Sep. 27, 1983 | [JP] | Japan | 58-149971[U] |
| Sep. 27, 1983 | [JP] | Japan | 58-149972[U] |
| Sep. 27, 1983 | [JP] | Japan | 58-149974[U] |

[51] Int. Cl.[4] ..... G03G 15/00

[52] U.S. Cl. ..... 355/3 SH; 355/3 DR; 271/9

[58] Field of Search ..... 355/3 SH, 3 R, 3 DR, 355/14 SH; 271/272-274, 9

[56] References Cited

U.S. PATENT DOCUMENTS

| | | | |
|---|---|---|---|
| 3,512,884 | 5/1970 | Murgas et al. | 271/272 X |
| 3,713,735 | 1/1973 | Wilber | 271/272 X |
| 4,062,533 | 12/1977 | Greenberg | 271/9 X |
| 4,335,950 | 6/1982 | Gunzelmann et al. | 355/3 SH |
| 4,350,439 | 9/1982 | Tanioka et al. | 355/3 SH |
| 4,403,851 | 9/1983 | Yanagawa | 355/3 BE |
| 4,412,734 | 11/1983 | Shibuya et al. | 355/3 SH |
| 4,508,444 | 4/1985 | May et al. | 355/3 SH |
| 4,531,823 | 7/1985 | Deguchi et al. | 355/3 SH |

*Primary Examiner*—R. L. Moses

*Attorney, Agent, or Firm*—Frishauf, Holtz, Goodman & Woodward

[57] ABSTRACT

An image recording apparatus comprises an automatic paper feeder for feeding recording paper one after another from a stack of paper; a manual paper feeder for feeding recording paper manually; and a main body which is formed of an upper frame coupled to a lower frame, the upper and lower frames being separable relative to each other. At least a part of the automatic paper feeder and at least a part of the manual paper feeder are arranged in one unit frame which is coupled to the main body. One end of the unit frame is displaceably arranged relative to the main body when the upper and lower frame are relatively separated.

16 Claims, 17 Drawing Figures

IMAGE RECORDING APPARATUS WITH SEPARABLE UPPER AND LOWER SECTIONS AND DISPLACEABLE PAPER FEED UNIT

BACKGROUND OF THE INVENTION

1. Field of the Invention

This invention relates to an image recording apparatus such as an electrostatically copying apparatus and more particularly to an image recording apparatus equipped with an improved paper feeding means.

2. Description of the Prior Art

In such an image recording apparatus as an electrostatically copying apparatus, an objective record is obtained in such a manner that an electrostatic image is formed on such an electrostatic image carrier as a photoreceptor drum, and toners are adhered to the electrostatic image so as to be visualized by means of a developing device and the toner image thereof is transferred onto a sheet of recording paper and is then fixed thereon.

FIG. 1 illustrates one of the general structures of the abovementioned copying apparatus as an example of the image recording apparatuses, wherein cassette 1 is filled with a stack of recording paper P and is then put in the copying apparatus. The recording paper P is sent out one after another automatically by paper feed roller 2 to an image transfer section upon being guided by guide plates 3, 4 and regulating the timing of paper feeding by means of resist-rollers 5. The recording paper P fed into the image transfer section is brought into contact with the surface of photoreceptor drum 6 carrying a toner image thereon and is then adsorbed on the surface thereof by the electric charge of photoreceptor drum 6, so that the toner image carried on photoreceptor drum 6 is transferred by the discharge of image transfer electrode 7. After completing the toner image transfer, the recording paper P is separated from the surface of the photoreceptor drum 6 by the A.C. corona discharge from separation electrode 8 and is then advanced through fixing rollers 9 so as to complete a record. The record is then ejected to the outside of the copying apparatus by paper exit rollers 10.

In the case of such a copying apparatus as illustrated in FIG. 1, the path of recording paper P may be arranged in a simple form without many bends. Therefore, troubles arise along with the transport (including a feeding) of recording paper P are relatively a few. However, if using a sheet of curly paper, the so-called jamming trouble would be caused in the paper transport (feeding) path. This jamming trouble must be remedied. Japanese Patent Examined Publication No. 40827/1981 is one example of a practical application of this, so as to make the maintenance easier, wherein a copying apparatus is so constructed as to be separated into the upper part and the lower part respectively taken on, for example, line X-X' shown in FIG. 1 practically drawn along the path of recording paper. The upper and lower parts are incorporated in upper frame 11 and lower frame 12 so that one end of upper frame 11 may be attached rotatably to lower frame 12 through shaft 13. Even when there is a problem in the process of paper transport, it is very easy to remove a sheet of jammed paper and to remedy a problem by lifting upper frame 11 in the direction of arrow b, because the paper transport section or the paper feeding section can be separated upward and downward.

In recent years, there are demands for such a copying apparatus having a complicated paper feeding path as those provided with a manual paper-feed system in which specific paper is manually fed, or with a paper feed and eject system in which a sheet of fed paper makes a U-turn inside the apparatus so that the paper may be fed and be then ejected from the same side of the apparatus. In these kinds of apparatus, however, there are many instances where the maintenance of the paper feeding system can be accomplished only if it is provided with the abovementioned structure separable upward and downward, and there have accordingly been a desire improvements thereon.

OBJECT AND SUMMARY OF THE INVENTION

It is, therefore, an object of the invention to provide a copying apparatus provided with an automatic paper feeding means and a manual paper feeding means, wherein in each maintenance can easily be done.

The abovementioned object of the invention can be achieved by an image recording apparatus comprising, an automatic paper-feeding means capable of feeding a stack of recording paper loaded therein one after another automatically; a manual paper-feeding means capable of feeding a sheet of recording paper fed manually; and a main body capable of being separated into an upper frame and a lower frame. The image recording apparatus is characterized in that at least a part of the abovementioned automatic paper-feeding means and at least a part of the manual paper-feeding means are arranged in one unit, and one end of the unit is pivotally suspended to a portion of either the lower or upper frame. Furthermore, it can be structured that this unit is arranged together with an image transfer electrode and a separation electrode so as to serve as a paper-feed unit united into a body.

The object of the invention can also be achieved by an image recording apparatus in which one end of the abovementioned upper frame is fitted rotatably to one end of the lower frame by a shaft member, the image recording apparatus being characterized in that at least part of the automatic paper-feeding means and at least part of the manual paper-feeding means are fitted to the unit frame, and one end of the unit frame is rotatably pivot-suspended to the shaft member. This unit may be arranged together with an image transfer electrode and a separation electrode so as to serve as a paper-feed unit united into a body.

In these image recording apparatuses, the abovementioned automatic paper-feeding means comprises a semi-lunar roller (roller which has cross-section of semi-lunar type) for sending out a stack of recording paper intermittently as an example of sending means, a paper feed roller as an intermittent driving roller and the like, a guide-plate for guiding the direction of feeding of paper sent out, and a resist-roller for regulating the position of paper and a feeding timing (restart timing), and, besides the above, another auxiliary transport roller may be added thereto. The abovementioned manual paper-feeding means comprises a transport roller for receiving a sheet of recording paper, a guide plate, a resist-roller, and the other auxiliary transport roller, and some of them may also be used for those of the automatic paper-feeding means in combination.

Namely, should there be a paper jam in either the abovementioned automatic paper feed path or the manual paper feed path, one of the paper feed paths can be laid bare by separating the upper frame of the recording apparatus from the lower frame thereof and by keeping them open. In this case, there would be no problem if such a jammed paper can be removed in this state. However if such a jammed paper is in the other paper feed path, it would not be removable.

In this invention, at least a part of the automatic paper feed path and at least a part of the manual paper feed path are incorporated in a unit so as to be displaceable. It is therefore possible to lay a jammed paper stuck in the other paper feed path bare and to take it out, if the movable unit is moved (i.e. by rotating the unit.)

BRIEF DESCRIPTION OF THE DRAWINGS

FIG. 3 illustrates same in the separated state;

FIG. 5 illustrates same in the separated state;

FIG. 7 illustrates same in the separated state;

FIG. 16 is a perspective view of the structure of the manual paper feed tray, and FIG. 17 is a conceptual illustration displaying the effects obtained when the manual paper feed tray is used.

DESCRIPTION OF THE PREFERRED EMBODIMENTS

Figure 1:
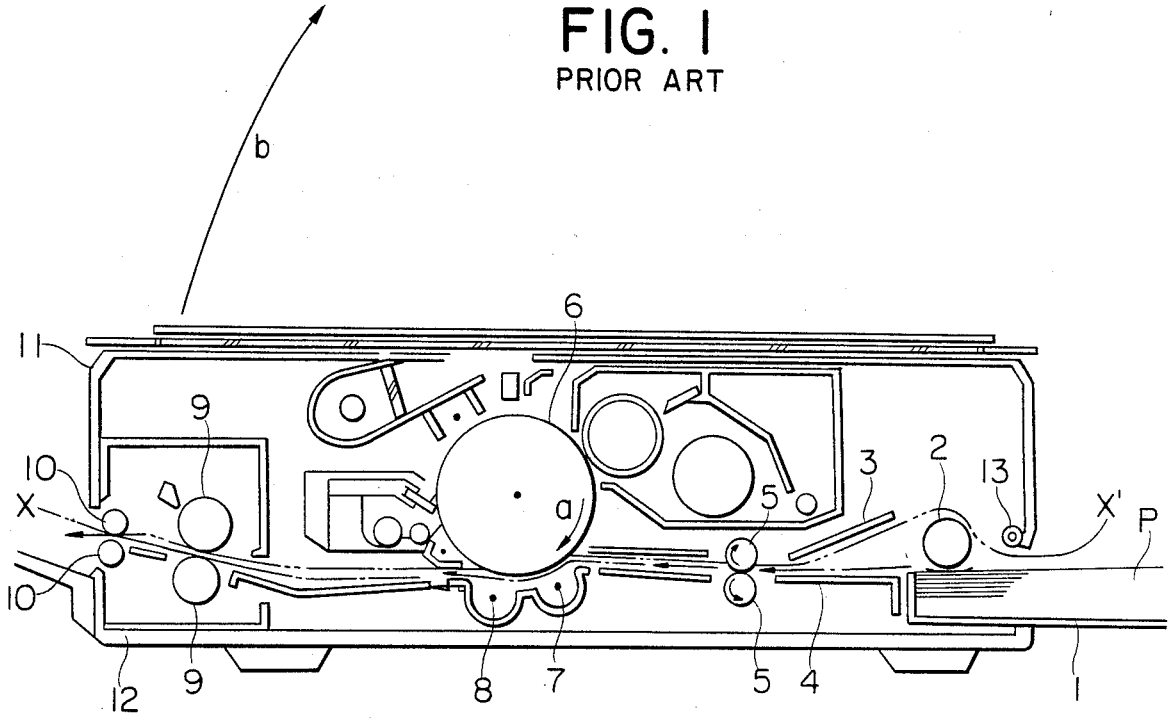
FIG. 1 PRIOR ART
FIG. 1 a schematic illustration of a general structure of an electrostatic copying apparatus.
Figure 2:
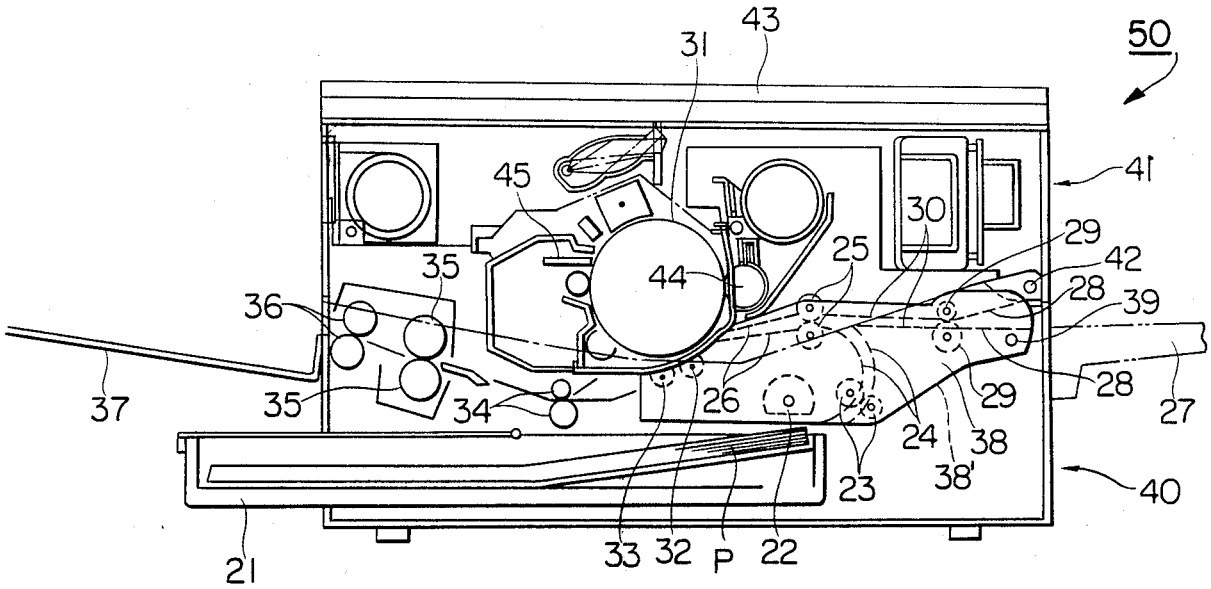
FIGS. 2 and 3 aach schematically illustrate the first example of the copying apparatuses embodying the invention, and, inter alia.

FIG. 2 schematically illustrates the first example of the copying, apparatuses embodying the invention. recording paper P for automatic paper feed use is stacked up in paper feed cassette 21 and is loaded on the copying apparatus. Every sheet of the paper is then intermittently sent out one after another by the rotation of semi-lunar roller 22. The sheets of paper thus sent out from the paper feed cassette are fed by paper transport rollers 23 and guide plates 24 and are regulated in the alignment and restart timing thereof by resist-rollers 25. Then they are transported along guide plates 26 to the image transfer section.

In the case of manual feeding, a sheet of recording paper is manually fed from manual feed table 27 along guide plates 28, and is transported to resist-rollers 25 by manual paper-transport rollers 29 and guide plates 30. Thereafter, the sheet of paper is put into the same paper-feeding path as in the case of the automatic paper-feeding. Resist-rollers 25 are used in combination for both of the automatic and manual paper feed system. Paper coming into contact with photoreceptor drum 31 carrying thereon a toner image is transferred with the toner image from the photoreceptor drum by the work of image transfer electrode 32 and is separated from the surface of the photoreceptor drum and is then transported to the fixing section by paper transport rollers 34 and fixed by fixing rollers 35. The paper is then ejected to paper receiving tray 37 by ejecting rollers 36.

In this apparatus, as illustrated in the drawing, the automatic paper-feeding means comprising semi-lunar roller 22, paper transport rollers 23, guide plates 24, and resist-rollers 25, and the manual paper-feeding means comprising guide plates 28, 30 and paper-feeding rollers 29 are assembled into a body to serve as a paper feed unit (unit frame) with frame bodies 38, 38' out of which 38' is of about the same in shape and is not shown because it is arranged behind the drawing, and the paper feed unit (unit frame) is rotatably pivoted to lower frame 40 of the apparatus body by shaft member 39. Upper frame 41 of the apparatus body is so constructed as to be rotatably pivoted to lower frame 40 by shaft member 42, and to be opened upward if occasion demands. The dot-dash line in FIG. 2 indicates the separation line of upper frame 41 from lower frame 40. The upper and lower frames 40, 41 together form the main body 50 of the appartus.

Figure 3:
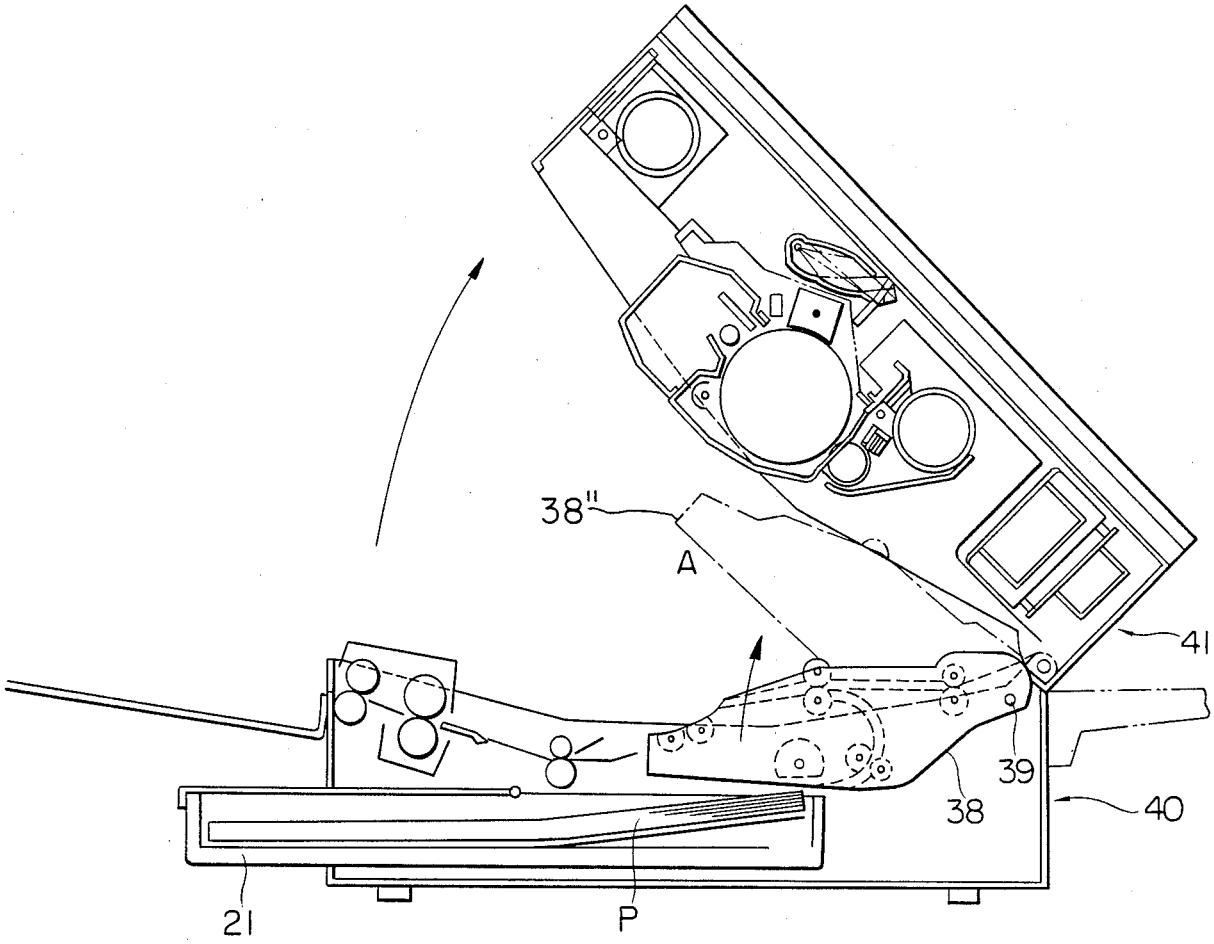

FIG. 3 illustrates such a state where the upper and lower frames of a copying apparatus (main body) are opened relative to each other. In case of jamming in a manual paper-feeding path on the upper side of the paper feed unit, such a jamming may easily be remedied by making the apparatus to be in this state. In case of causing a trouble in an automatic paper-feeding path below or inside the paper feed unit, the trouble is easily remedied, similar to the case of the upper side, by rotating the paper feed unit to the position of 38 without disassembling the apparatus. Thereafter copying operations may be resumed immediately by closing the paper feed unit and the upper frame.

In FIGS. 2 and 3, 43 is a document table, 44 is a developing device, and 45 is a cleaning device.

As is obvious from the examples described above, according to the invention, it is possible to manufacture the image recording apparatuses provided with a paper feeding system which may very easily be maintained. It is to be understood not only that the embodiments of the invention shall not be limited to the described examples, but that various alterations thereof may be made without departing from the spirit and scope of the invention.

Figure 4:
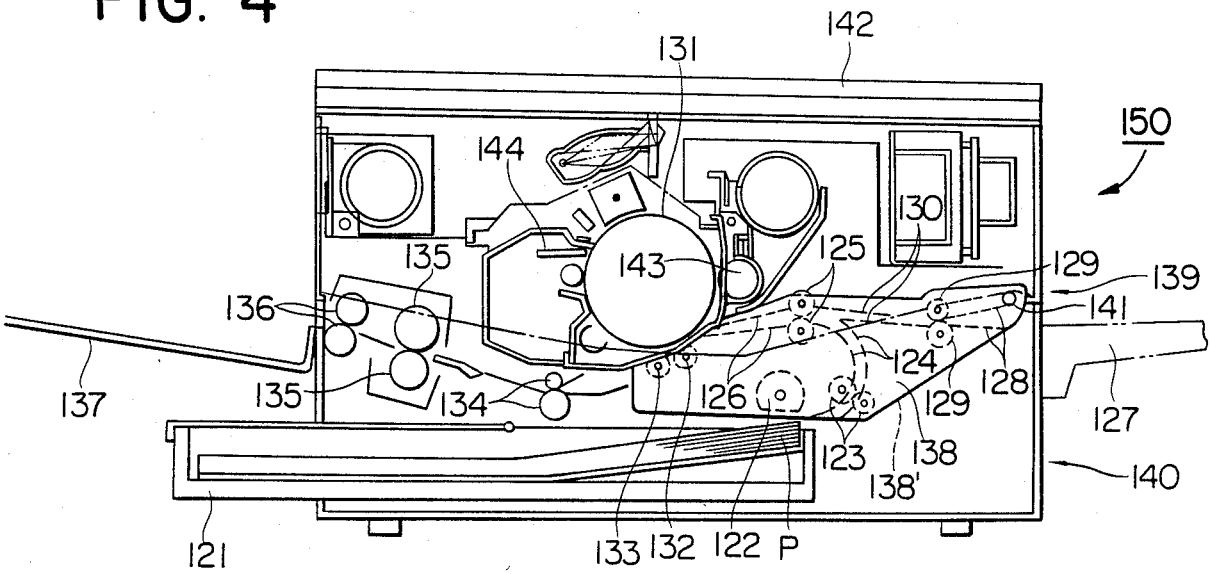
FIGS. 4 and 5 each schematically illustrate the second example of the copying apparatuses embodying the invention, and, inter alia

FIG. 4 schematically illustrates the second example of the copying apparatuses embodying the invention. Wherein, recording paper P for automatic paper feed use is stacked up in paper feed cassette 121 and is loaded on the copying apparatus. Every sheet of the paper is then intermittently sent out one after another by the rotation of semi-lunar roller 122. The sheets of paper thus sent out from the paper feed cassette are fed by paper transport rollers 123 and guide plates 124 and are regulated in the alignment and restart timing thereof by resist-rollers 125. Thereafter, they are transported along guide plates 126 to the image transfer section.

In the case of manual feeding, a sheet of recording paper is manually fed from manual feed table 127 along guide plates 128, and is fed to resist-rollers 125 by manual paper-transport rollers 129 and guide plates 130. Thereafter, the sheet of paper is put into the same paper-feeding path as in the case of the automatic paper-feeding. Resist-rollers 125 are used in combination for both of the automatic and manual paper feed systems. Paper coming into contact with photoreceptor drum 131 carrying thereon a toner image is transferred with the toner image from the photoreceptor drum by the work of image transfer electrode 132 and is separated from the surface of the photoreceptor drum by separation electrode 133 and is then transported to the fixing section by paper transport rollers 134 and fixed by fixing rollers 135. The paper is then ejected to paper receiving tray 137 by ejecting rollers 136.

In this apparatus, as illustrated in the drawing, the automatic paper-transport means comprising semi-lunar roller 122, paper transport rollers 123, guide plates 124, and resist-rollers 125, and the manual paper-feeding means comprising guide plates 128, 130 and paper transport rollers 129 are assembled into a body to serve as a paper feed unit with frame bodies 138, 138' out of which 138' is of about the same in shape and is not shown because it is arranged behind the drawing.

Figure 5:
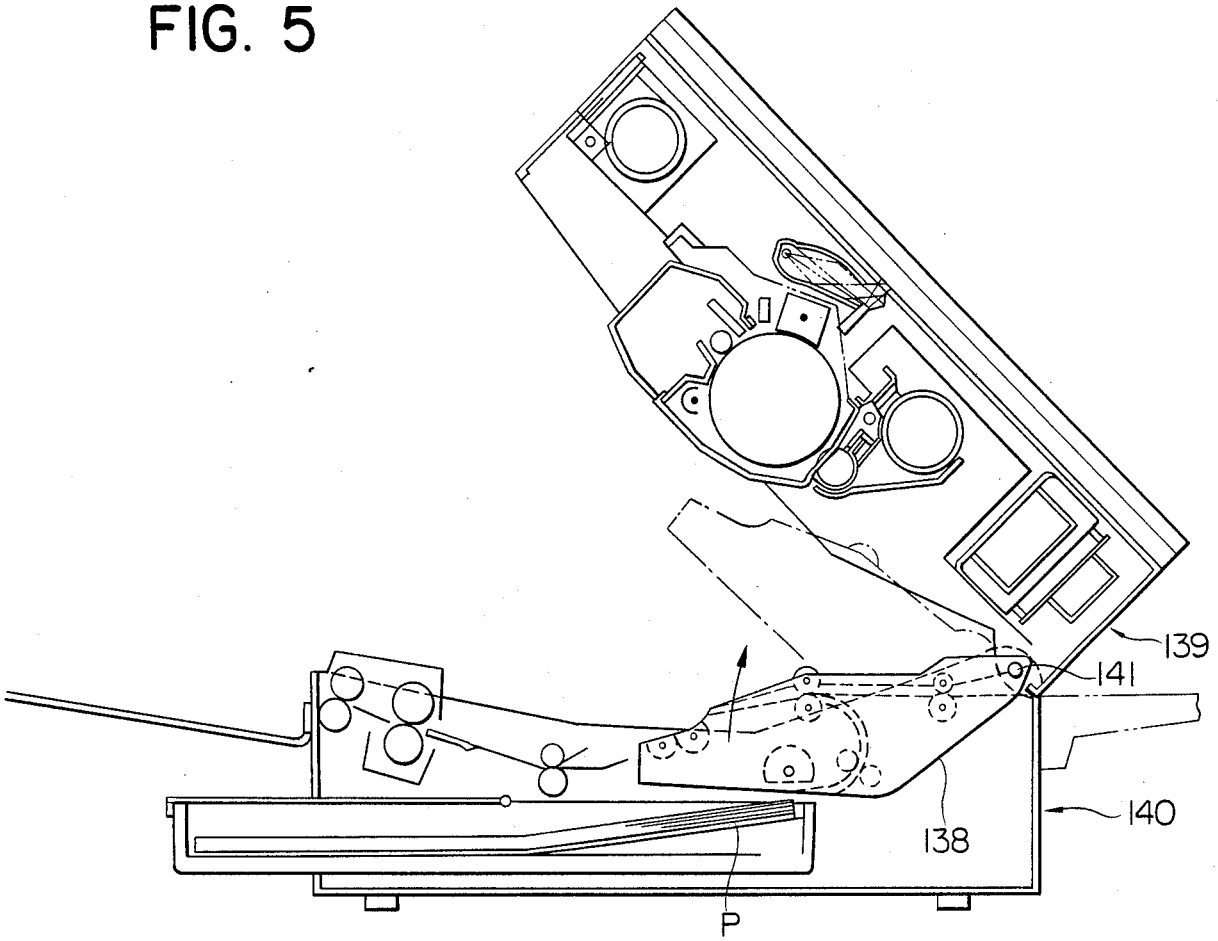

This type of copying apparatus comprises a main body 150 which is separated into an upper frame 139 a and lower frame 140 so that both frames can be opened by rotating upper frame 139 upward. Both frames are rotatably pivoted by shaft member 141. The paper feed unit frame 138 (138'), is also rotatably pivoted by one and the same shaft member 141. The dot-dash-line in FIG. 4 indicates the separation line of upper frame 139 from lower frame 140. FIG. 5 shows such a state where the upper frame of a copying apparatus is opened upward. In case of paper jamming in a manual paper-feeding path on the upper side of the paper feed unit, such a jamming may easily be remedied by making the apparatus be in this state. In case of causing a trouble in an automatic paper-feeding path below or inside the paper feed unit, the trouble is easily remedied, similar to the case of the upper side, by rotating the paper feed unit to the position of A without disassembling the apparatus and after then the copying operation may be resumed immediately by closing the paper feed unit and the upper frame.

In FIGS. 4 and 5, 142 is a document table, 143 is a developing device, and 144 is a cleaning device.

As is obvious from the examples described above, according to the invention, it is possible to manufacture the image recording apparatuses provided with a paper feed system which may very easily be maintained. It is to be understood not only that the embodiments of the invention shall not be limited to the described examples but that various modifications thereof may be made without departing from the spirit and scope of the invention.

Figure 6:
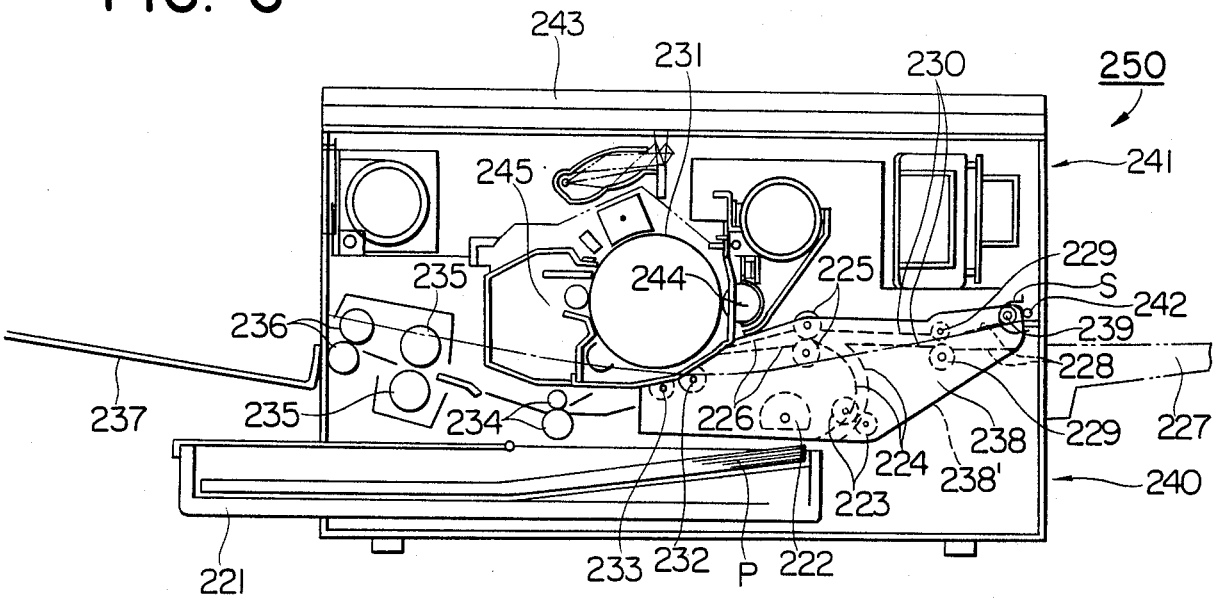
FIGS. 6 and 7 schematically illustrate the third example of the copying apparatuses embodying the invention, and, inter alia.

FIG. 6 schematically illustrates the third example of the copying apparatuses embodying the invention. Recording paper P for automatic paper feed use is stacked up in paper feed cassette 221 and is loaded on the copying apparatus and every sheet of the paper is then intermittently sent out one after another by the rotation of semi-lunar roller 222. The sheets of paper thus sent out from the paper feed cassette are fed by paper transport rollers 223 and guide plates 224 and are regulated in the alignment and timing thereof by resist-rollers 225. Then they are transported along guide plates 226 to the image transfer section.

In the case of manual feeding, a sheet of recording paper is manually fed from manual feed table 227 along guide plates 228, and is transported to resist-rollers 225 by manual paper-transport rollers 229 and guide plates 230. Thereafter, the sheet of paper is put into the same paper-transport path as in the case of the automatic paper-feeding. Resist-rollers 225 are used in combination for both of the automatic and manual paper feed systems. Paper coming into contact with photoreceptor drum 231 carrying thereon a toner image is transferred with the toner image from the photoreceptor drum by means of image transfer electrode 232 and is separated from the surface of the photoreceptor drum by separation electrode 233 and is then transported to the fixing section by paper transport rollers 234 and fixed by fixing rollers 235. The paper is then ejected to paper receiving tray 237 by ejecting rollers 236.

In this apparatus, as illustrated in the drawing, the automatic paper-feeding means comprising semi-lunar roller 222, paper transport rollers 223, guide plates 224, and resist-rollers 225, and the manual paper-feeding means comprising guide plates 228, 230 and paper transport rollers 229 are assembled into a body to serve as a paper feed unit with frame bodies 238, 238' out of which 238' is of about the same in shape and is not shown because it is arranged behind the drawing. The paper feed unit is rotatably pivoted to upper frame 241 of the copying apparatus body (main body 250) by shaft member 239.

Upper frame 241 of the copying apparatus body is so constructed as to rotatably be pivoted to lower frame 240 and to open upward if occasion demands. The dot-dash-line in FIG. 6 indicates the separation line of upper frame 241 from lower frame 240. Frame body 238 of the paper feed unit is provided with a locking mechanism (not shown) so that the paper feed unit can be locked (not shown) so as not to rotate downward, and that the paper feed unit can be unlocked if required so as to be rotatable. A powerful spring S is coupled to shaft member 239 so that frame bodies 238, 238' may not readily fall from upper frame 241 and may constantly be pressed upward.

Figure 7:
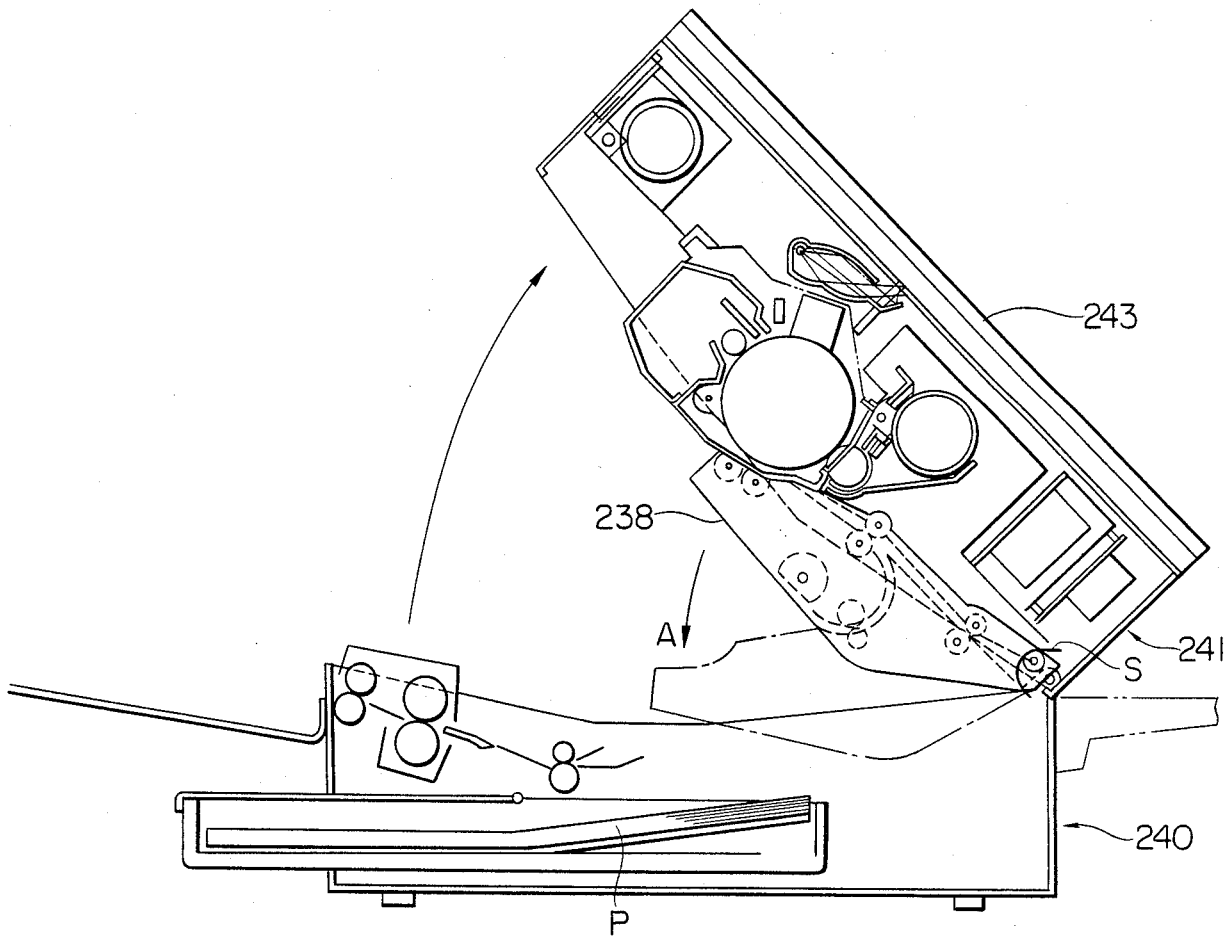

FIG. 7 illustrates such a state where upper frame 241 is opened upward. The image-forming section such as a photoreceptor drum and the paper feed unit (unit frame) are lifted together with upper frame 241 and the bottom surface of the paper feed unit is revealed, and it is, therefore, readily possible to remedy any paper jamming and the like if it is caused in the vicinity thereof.

If a trouble happens on the upper side of the paper feed unit, e.g., in the manual paper-feeding path, such a trouble may readily be remedied, similar to the case of a trouble on the lower side of the paper feed unit, in such a way that the paper feed unit is unlocked and is then rotated to position A so as to reveal the upper side of the paper feed unit.

In either cases, it is possible to resume copying immediately after remedying the trouble by closing the paper feed unit and upper frame 241 without necessarily disassembling the apparatus. In FIGS. 6 and 7, 243 is a document table, 244 is a developing device, and 245 is a cleaning device.

As is obvious from the described examples, according to the invention, it is possible to manufacture the image recording apparatuses provided with a paper feeding system which may easily be maintained. It is to be understood not only that the embodiments of the invention shall not be limited to the described examples, but that various modifications thereof may be made without departing from the spirit and scope of the invention.

For example, in the first through the third examples, every recording apparatus is arranged to be divided into upper and lower frames. These frame bodies are rotatably pivoted to their shaft members. On the point of displacement of the upper frame and the lower frame, besides the above structures, they may also slidably be provided to a part of the recording apparatus such as the lower frame.

The invention is applicable to various types of the apparatuses using image-transfer means and separation means, that is to say, the invention is applicable not only to those using electrodes but also to those using claw or belt-type separation means or roller-type image transfer means.

In the invention, it is also allowable as a matter of course that an image transfer means or separation means is not provided to the described frame bodies capable of being displaced, but is provided to the other members. It is, needless to say, very convenient for remedying paper jamming, etc., to provide such image transfer means and separation means on displaceable frame bodies.

Figure 8:
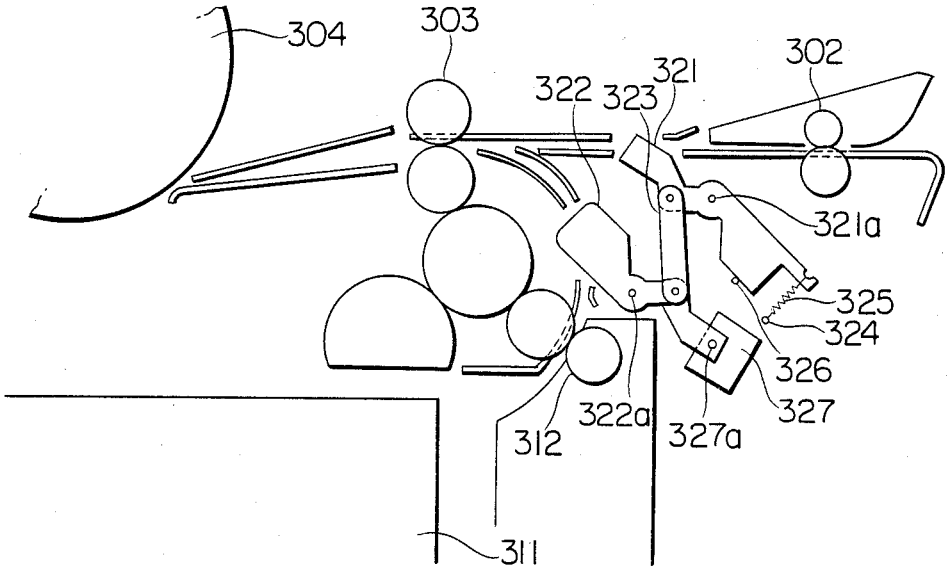
FIGS. 8 and 9 each illustrate the embodiments of the invention respectively in which a sensor member is attached to the paper feeding path of a copying apparatus.

Referring to a recording apparatus described in the example in which two paper feeding paths, one for manual feed and the other for automatic feed from a cassette are provided thereto, a single sensor member is arranged so as to detect sheets of recording paper passing through the respective paper feed paths. Thus, a single sensor can confirm the paper feed conditions and obtain synchronizing signals to be given for the other operation, so that the number of parts can be reduced and the assembling labor is economized as well as the price thereof can be advantageously established. FIG. 8 illustrates the substantial portions of such a system, wherein actuator 321 rotatable about suspending shaft 321*a* is provided so that one end of the actuator can intrude into the manual paper feeding path formed by guide plates between first paper feed rollers (first paper transport rollers) 302 and second paper feed rollers (as resist-rollers) 303. On the other hand, actuator 322 rotatable about suspending shaft 322*a* is provided so that one end of the actuator can intrude into the paper feed path formed for paper feed unit by the guide plates between first paper feed rollers 312 and the described second paper feed rollers 303.

Very soft tension spring 325 is provided between the other end of the actuator 321 and fixed pin 324 so as to energize the actuator 321 clockwise, while actuator 321 is regulated to rotate over the limit by stopper 326.

Actuator 321 and the actuator 322 are connected, between the respective sides of suspending shafts 321*a*, 322*a* which are opposite to each other, by means of connecting rod 323. Further, the other end of the actuator 322 is in a state covering photoreceptor 327*a* of the sensor member, i.e., photosensor 327.

For example, when a sheet of recording paper is fed manually with such a paper feed unit constructed as mentioned above, the leading edge of the paper presses one end of the actuator 321 so as to clear it off to the outside of the guide plates i.e., the paper feed path, and at this moment the actuator 321 starts to rotate counterclockwise against tension spring 325. As a result, the described connecting rod 323 descends and at the same time rotates the actuator 322 clockwise. Therefore, the other end of actuator 322 moves from the position where it covers photoreceptor 327*a* of the described photosensor, and accordingly the photoreceptor 327*a* receives a ray of light emitted from a light emitter (not shown), so that a paper feed can be confirmed and a synchronizing signal can also be given.

Similar to the former case, in the latter case too, actuator 322 functions according to the functions of actuator 321, in quite the same manner. It is also the same as in the former case that the leading edge of recording paper fed out from paper feed cassette 311 presses the actuator 322 to clear off to the outside of guide plates, and that the actuator 322 is rotated clockwise to uncover photoreceptor 327*a* of the photosensor 327 and the photoreceptor 327*a* is covered again by the other end of actuator 322 by the action of the described tension spring 325, after a sheet of paper passes through.

Figure 9:
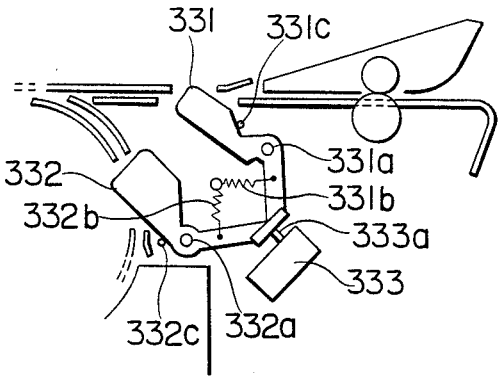

As illustrated in FIG. 9, it is also possible to construct the paper feed unit in which actuators 331 and 332 are respectively provided so as to function independently and to be energized to rotate about suspending shafts 331*a* and 332*a* clockwise or counterclockwise, by tension springs 331*b* and 332*b*, so that the actuators may bump into stoppers 331*c* and 332*c*, respectively. In this instance, either actuator 331 or 332 is cleared off to the outside of the guide plates, and the leg of the actuator cleared off pushes down push-pin 333*a* of micro-switch 333 that is the sensor member, so that a signal may be given, similar to the former example.

In such recording apparatuses as described in the examples of the invention, it causes a trouble therein that a manual paper feed is done while a sheet of paper is being transported.

Following is a discussion of three examples of recording apparatus having a paper feed unit provided with a paper feed safety device for the purpose of preventing the abovementioned trouble.

The following description is of the paper feed unit of a copying apparatus of the invention, which is provided with a means for making any manual paper feed inoperable in the course of transporting a sheet of recording paper toward the secondary paper feed member and with a means for releasing the abovementioned inoperability of the manual paper feed at the time of starting the secondary paper feed member in operation.

Figure 10:
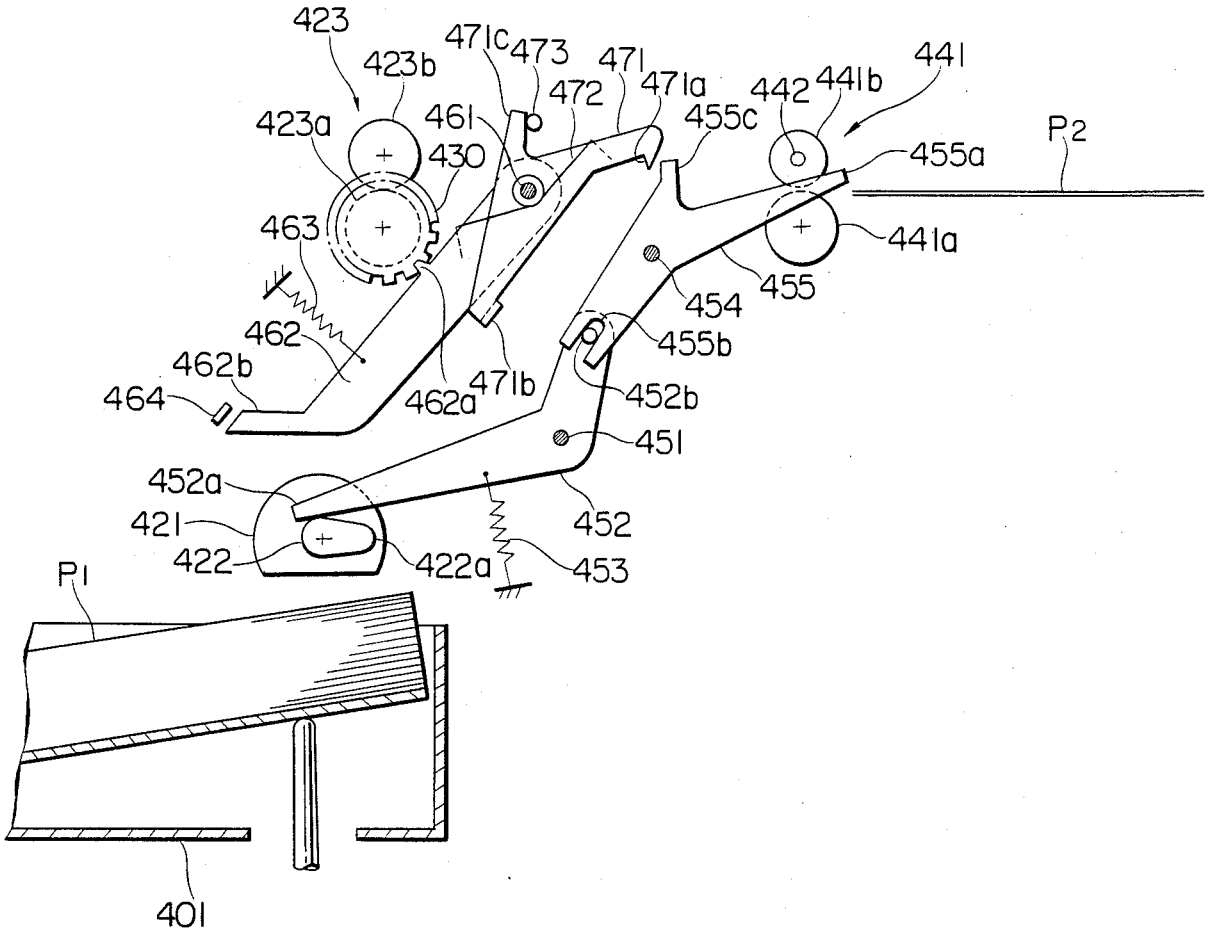
FIGS. 10 through 12 inclusive, illustrate the embodiments of the invention respectively, in which a paper feed safety device is attached to the paper feed section of a copying apparatus.
Figure 11:
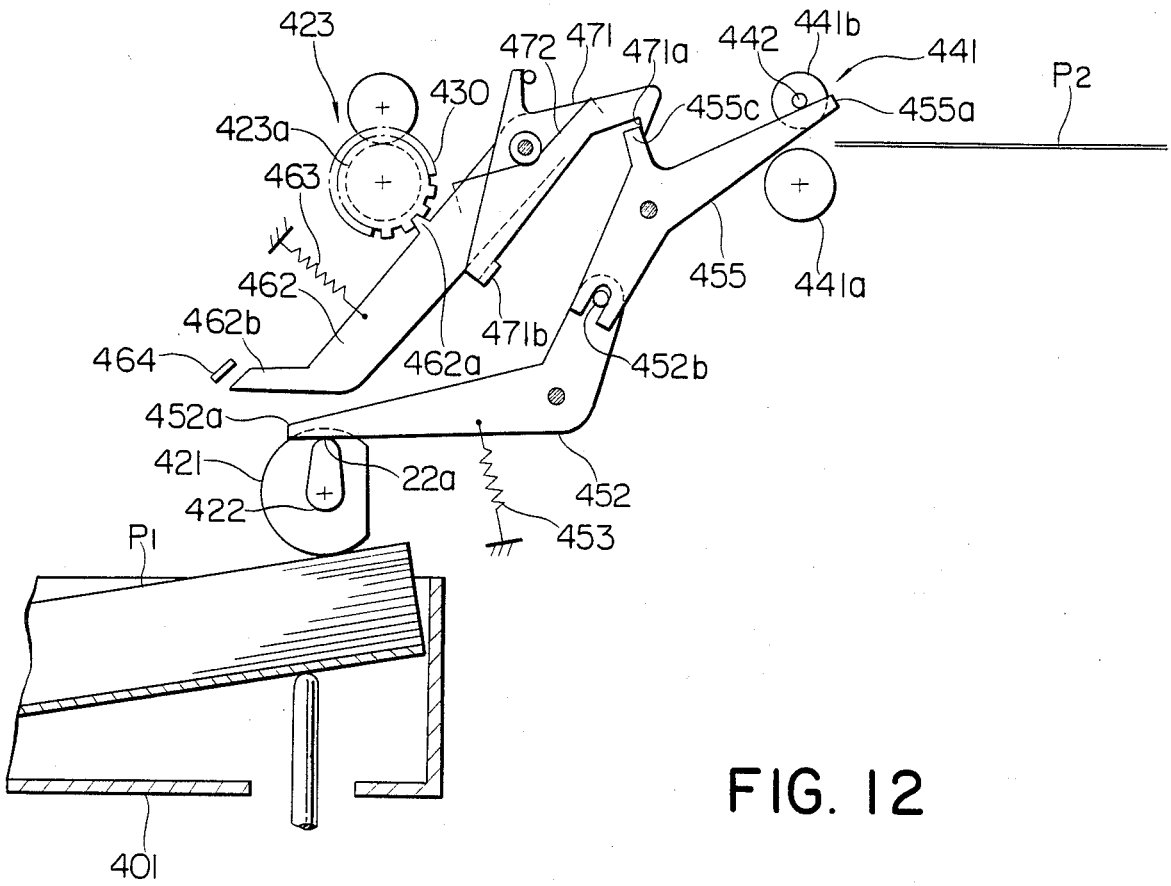
Figure 12:
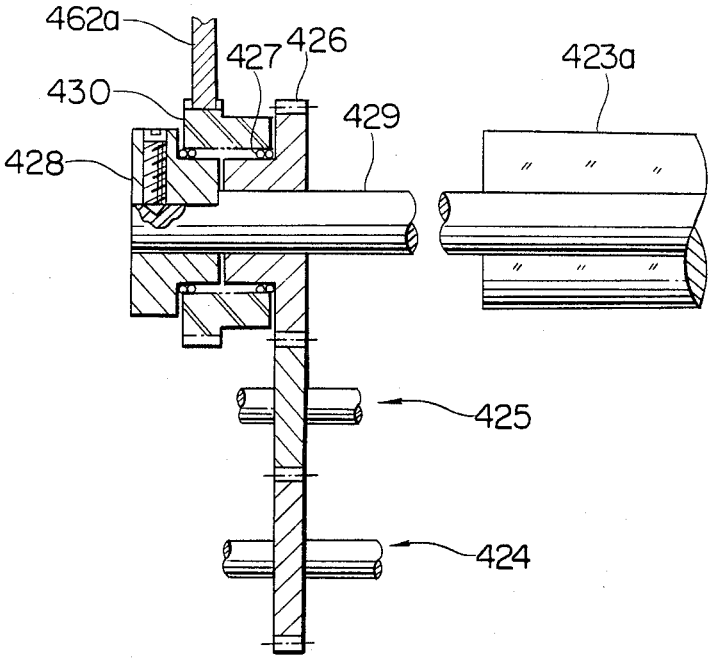

One of the examples of the abovementioned paper feed unit is illustrated in FIGS. 10 through 12, respectively.

A semi-lunar roller 421 which is rotated by the driving system of a copying apparatus and is coaxially united with cam 422, is so arranged as to face recording paper P1 stacked in paper feed cassette 401. Above the described semi-lunar roller 421, there is provided a set of second paper feed roller 423 for feeding recording paper P1 to a region for an image forming process after the recording paper is transported from the paper feed cassette 401 and is turned over by way of the first paper feed rollers and guide plates (not shown either).

The second paper feed rollers 423 comprise driving roller 423*a* and driven roller 423*b* which is rotated in pressure contact with the driving roller 423*a*. As illustrated the sectional view of the driving roller 423*a*, it is mounted to revolving shaft 429 joined to rotation ring 428 which is driven by and united with gear 426 and spring clutch 427, each being rotated by driving systems 425 and 426.

Further, on the right hand side of the second paper feed rollers 423 is provided with first paper feed rollers 441 for transporting recording paper P2 fed manually to the second paper feed rollers 423.

The first paper feed rollers 441 comprise driving roller 441*a* and driven roller 441*b* which is rotated in pressure contact with the driving roller 441*a* by an elastic member (not shown). On the other hand, driven roller 441*b* is so arranged as to move vertically (i.e., upward) to the driving roller 441*a* so that it may become free from the state in pressure contact with the driving roller 441*a*.

On the base board supporting each end of the semi-lunar roller 421, second paper feed rollers 423 and first paper feed rollers 441 for feeding recording paper P2 for manual feed use, each of the members for regulating the abovementioned group of rollers 421, 423 and 441 is also arranged.

Namely, to suspending shaft 451 on the base board, there is mounted with freely rotatable bell crank 452 of which one end 452*a* is brought by tension spring 453 into pressure contact with the outer circumferential surface of the cam 422 and the other end is provided with protruded pin 452*b*.

Meanwhile, to another suspending shaft 454 on the base board, there is rotatably mounted a swingable lever 455 of which one end 455*a* faces with some gap to pin 442 protruded from the side of the driven roller 441*b* and fork 455*b* at the other end holds the pin 452*b*, so that lever 455 may be driven by the bell crank 452. The swingable lever 455 further comprises a stopper protrusion 455*c* which will be described later.

In addition, to a further suspending shaft 461, there is mounted a freely rotatable stoper lever 462 energized or biased clockwise by tension spring 463 so that protrusion 462*a* on the stopper lever 462 may engage with the notch of notched wheel 430 fitted from the outside of the spring clutch 427 as shown in FIG. 12 so as to interfere with the rotation of the notched wheel 430, and the tip 462*b* of the stopper lever 462 may occupy a position within the region of operation of pressure member 464 operated by the control system of the copying apparatus. The pressure member 464 is operated according to the signals given from the driving system for adjusting the timing of an image formation with the timing of the photoreceptor drum and this member 464 is to be driven by a solenoid or cam.

Separate from the stopper lever 462, freely rotatable hook lever 471 is fitted into the described suspending shaft 461 and is energized or biased clockwise by torsion spring 472 suspended between the hook lever 471 and the stopper lever 462, and the hook lever 471 is stopped in motion by bringing the end 471*c* thereof into contact with stopper pin 473 on the base board. Hook 471*a* at the other end faces a position where protrusion 455*c* of the swingable lever 455 can be caught and bend 471*b* formed at another end occupies a position where it is brought into contact with the stopper lever 462 by rotating the stopper lever 462 counterclockwise.

The paper feed unit embodied in this example is so constructed as described above. Now, the functions thereof will be described hereunder.

FIG. 10 illustrates a state where a sheet of recording paper is fed manually. In this state, semi-lunar roller 421 is at a standstill. Accordingly, when driving roller 441*a* of first paper feed rollers 441 is rotated counterclockwise by the driving system of a copying apparatus, recording paper P2 is pressed on by the driving roller 441*a* and driven roller 441*b* to second paper feed rollers 423, and the recording paper P2 is fed into a region for an image formation process upon adjusting the timing by the counterclockwise rotation of driving roller 423*a* started in motion by the control system of the copying apparatus.

On the other hand, as illustrated in FIG. 10, when switching a paper feed mode to the mode using a paper feed cassette, semi-lunar roller 421 is rotated counterclockwise by the driving system of the copying apparatus, and when the semi-lunar roller 421 rotates about a quarter turn, the circumferential surface of semi-lunar roller 421 comes into contact with the uppermost recording paper P1 of a stack loaded on a paper feed cassette 401 and the uppermost recording paper P1 is going to be transported thereby to the inside of the copying apparatus. At the same time, the end 452*a* of bell crank 452 is lifted by point 422*a* of can 422 and bell crank 452 is then rotated clockwise against tension spring 453. According to the rotation of pin 452*b* of bell crank 452, swingable lever 455 is forced to rotate counterclockwise and the end 455*a* thereof lifts pin 442 of driven roller 441*b* of first paper feed rollers 441. Resultantly, driven roller 441*b* is released from the contact thereof with driving roller 441*a* to separate from each other. That is to say, when recording paper P1 is transported to feed from the described paper feed cassette 401, the copying apparatus becomes in no state to transport any of manually fed recording paper.

After protrusion 455*c* of the swingable lever 455 lifts up hook lever 471 in accordance with the counterclockwise rotation of the swingable lever 455, the protrusion 455*c* couples to the hook 471*a* of the hook lever 471 by the tension force of torsion spring 472 so as to be in the state shown in FIG. 11. Therefore, as shown in FIG. 11 even when semi-lunar roller 421 further rotates counterclockwise to complete a full turn, the driven roller 441*b* remains separated from driving roller 441*a*.

In other words, recording paper P2 which is to be fed manually remains interrupted in transport in the course of supplying recording paper P2 from paper feed cassette 401 to a copying apparatus. Therefore, recording paper in a manual feeding mode is never mingled with those in the automatic feeding mode even if trying a manual feeding carelessly. Therefore, any paper feed failure such as jamming does not occur at all.

Further, in this example, the state where the rollers of the first paper feed rollers are separated from each other remains as they are until second paper feed rollers 423 start in motion.

Namely, in FIGS. 11 and 12, gear 426 rotated by driving system 424, 425 of a copying apparatus inclines to rotate together with spring clutch 427. However, it cannot rotate because protrusion 462*a* is coupled to notched wheel 430 put in from the outside of spring clutch 427. Therefore, a friction force is generated between the outer circumferential surface of the spring clutch 427 and the notched wheel 430, and accordingly the inner diameter of the spring clutch 427 is expanded, so as to make the gear 426 idle. Driving roller 423*a* is mounted to rotation shaft 429 connected through ring 428 to the spring clutch 427 and resultingly, the driving roller 423*a* is kept at a stand-still.

Next, pressing member 464 is actuated by a signal given from the control system of the copying apparatus in which the paper feed timing was adjusted, so as to press down the end 462*b* and then to rotate stopper lever 462 counterclockwise against tension spring 463, and at this moment the protrusion 462*a* is disengaged from the notched wheel 430 to make the notched wheel free in motion, and resultantly, friction is not generated between the notched wheel and spring clutch 427. Accordingly, gear 426 and ring 428 are tightened to rotate respectively by spring clutch 427 so that driving roller 423*a* is rotated to feed recording paper P1 into a region for an image forming process.

At the same time, the stopper lever 462 presses bend portion 471*b* of hook lever 471 so as to rotate the hook lever 471 counterclockwise against the tension of torsion spring 472 and thus, protrusion 455*c* of swingable lever 455 is released from the stopped state by the hook 471*a*. On the other hand, in this point of time, semi-lunar roller 421 and cam 422 completed a full turn and are at a standstill in the position indicated in FIG. 10. Accordingly, the swingable lever 455 is rotated clockwise by the motion of bell crank 452 which is rotated counterclockwise by tension spring 453. Resultantly, driven roller 441*b* is descended by an elastic member (not shown) so as to put driving roller 441*a* again in a pressure contact state.

As described above, according to this example, any manual paper-feed is suspended from functioning from the start of transporting recording paper P1 from paper feed cassette 401 by means of semi-lunar roller 421 up to the start of feeding the recording paper P1 into the region for an image formation process.

It is, therefore, possible to prevent at a high probability any paper feed trouble caused by mingling recording paper P1 and P2 with each other.

A paper, feed unit exemplified in the above example comprises a means for making the above mentioned manual paper feed inoperable and a means for releasing the inoperability of the manual paper feed at the same time when the second paper feed member is started in operation, in the course of transporting a sheet of recording paper to the second paper feed member. In this type of paper feed unit, it is possible to provide same with a means for making the manual paper feed unit inoperable during the transporting of the recording paper, if constructing it as illustrated in FIG. 10 through 12.

Figure 13:
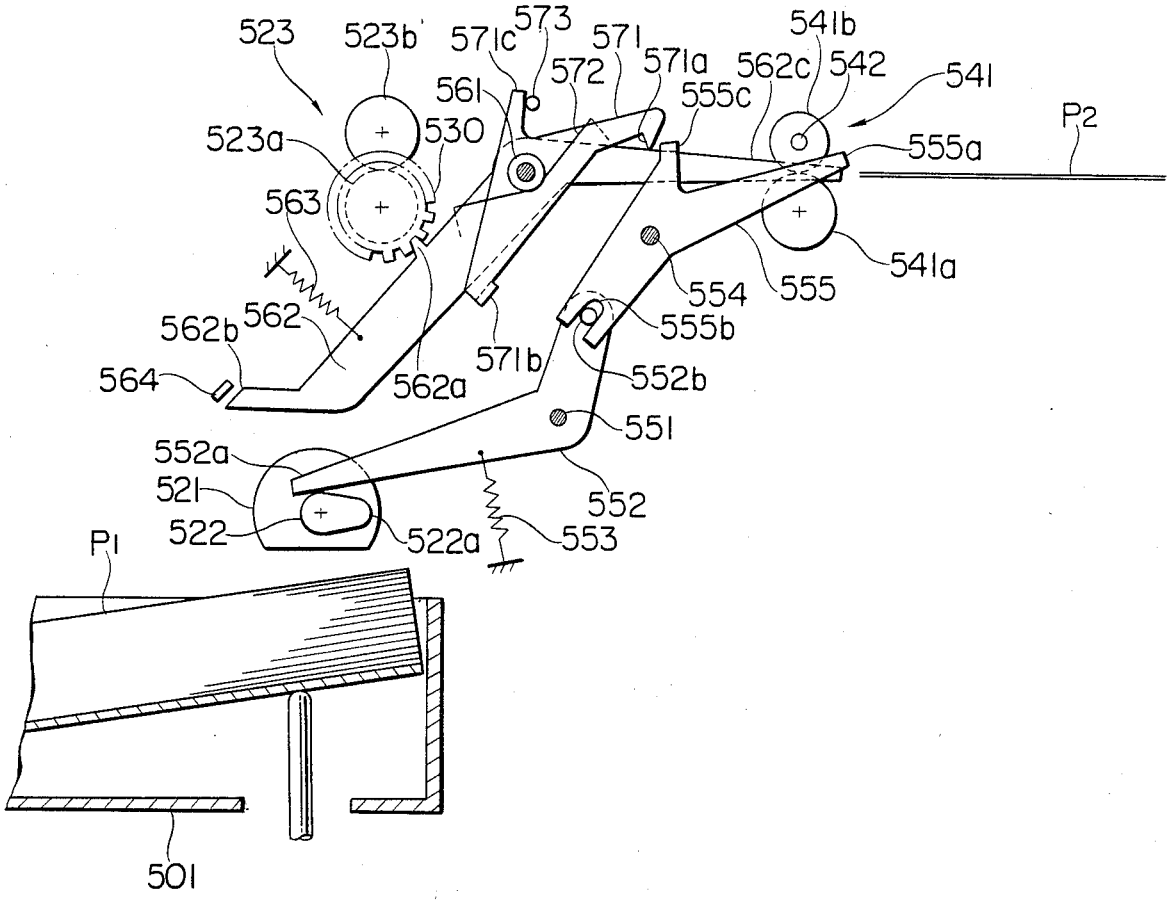
FIGS. 13 through 15, inclusive, illustrate further embodiments of the invention, respectively, in which a paper feed safety device is attached to the paper feed section of a copying apparatus.
Figure 14:
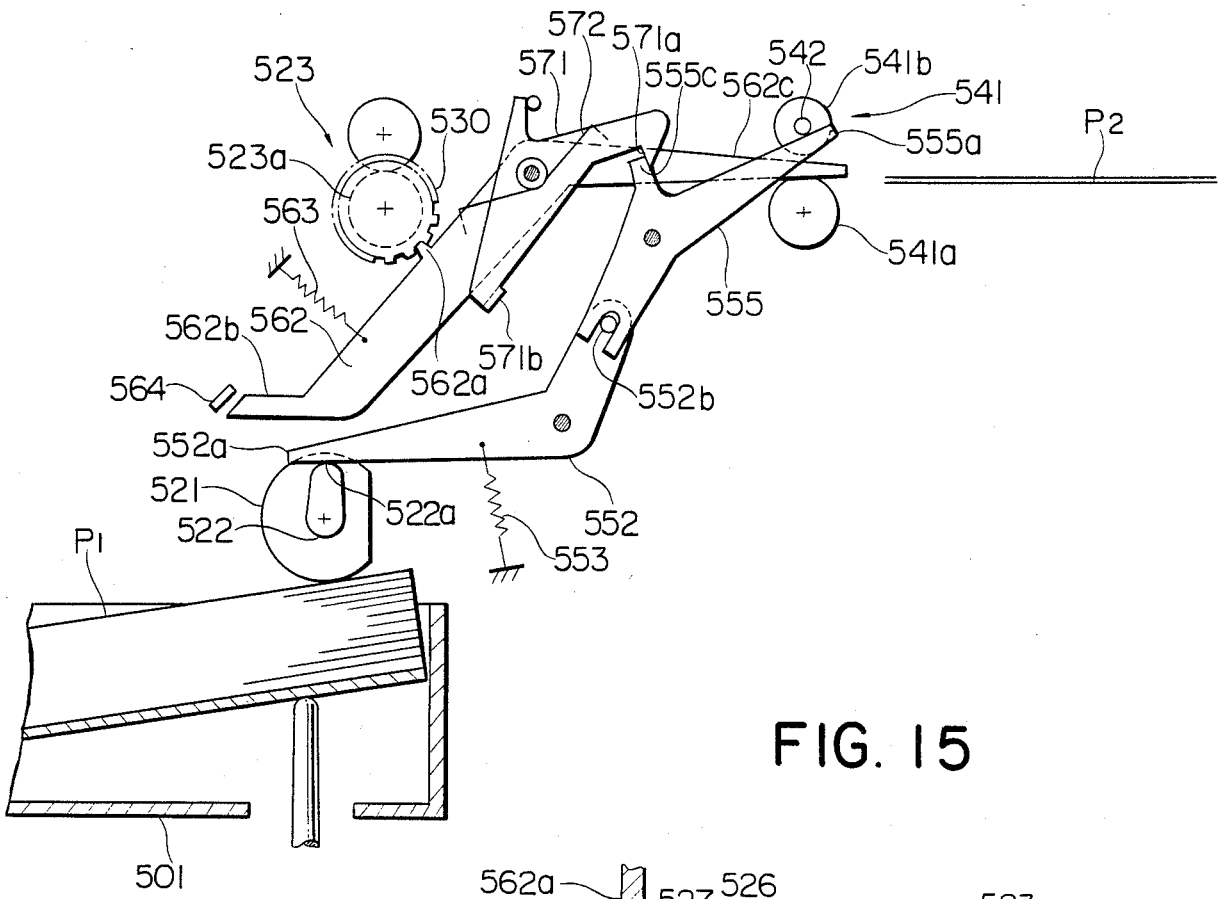
Figure 15:
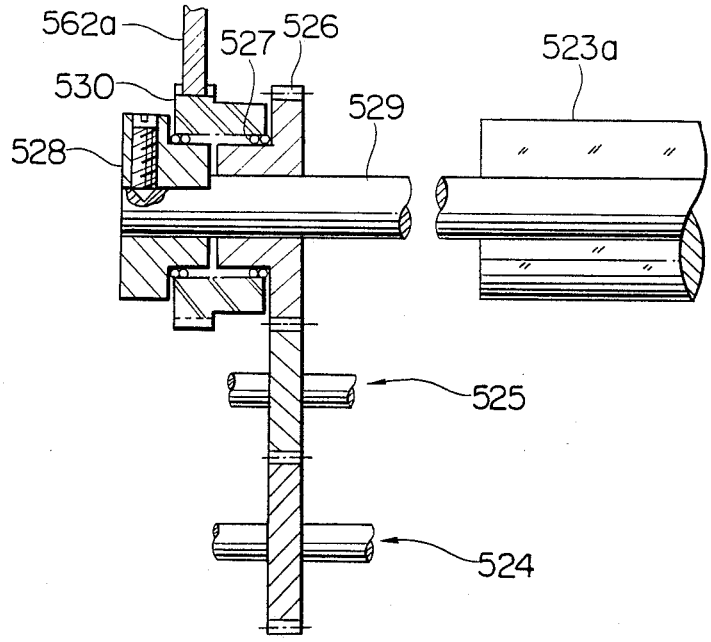

FIGS. 13 through 15 illustrate another example of the paper feed units of the copying apparatus of the invention in which the paper feed safety device is provided respectively thereto. This embodiment of the invention is so provided with a paper feed unit which transports a sheet of recording paper and with a means for making a manual paper feed inoperable by an actuator member which operates the second paper feed rollers, in the course of operating the second paper feed rollers.

Semi-lunar roller 521 rotated by the driving system of the copying apparatus is so arranged to be coaxially united with cam 522 in a body to face a sheet of recording paper P1 placed in paper feed cassette 501. Above the semi-lunar roller 521, second paper feed rollers 523 are arranged so as to feed an image formation process region with recording paper P1 turned over after passing through first paper feed rollers and guide plates (both are not shown) from the paper feed cassette 501.

The second paper feed rollers 523 comprises driving roller 523*a* and driven roller 523*b* being rotated by bringing it into pressure contact with the driving roller 523*a*. The driving roller 523*a* is, as the cross-sectional view thereof is illustrated in FIG. 15, attached to rotating shaft 529 connected to rotation ring 528 driven in a body with gear 526 rotated by driving system 524, 525 of the copying apparatus and with spring clutch 527.

On the right hand side of the second paper feed rollers 523, first paper feed rollers 541 are also arranged so as to transport manually inserted recording paper P2 to the second paper feed rollers 523.

The first paper feed rollers 541 comprises driving roller 541*a* and driven roller 541*b* which is rotated in pressure contact with an elastic member (not shown). The driving roller 541*a* is rotated by the driving system (not shown) of the copying apparatus and, on the other hand, the driven roller 541*b* is so constructed as to move in the vertical (i.e. upward) direction to the driving roller 541*a*, and as to be able to escape from the pressure-contact state.

On the base board supporting each end of the semi-lunar roller 521, second paper feed rollers 523, first paper feed rollers 541 for recording paper P2 which is manually fed, and the like, it is also provided with each of the members of the example for controlling the operations of the rollers 521, 523 and 541.

To be more concrete, bell crank 552 is freely rotatably mounted to one support shaft 551 on the base board. One end of the bell crank is brought into pressure contact with the outer circumferential surface of cam 522 by tension spring 553, and the other end thereof is provided with protruded pin 552*b*.

To another support shaft 554, swingable lever 555 is rotatably mounted so that one end 555*a* of the swingable lever 555 may face with a gap to protruded pin 542 at the side surface of the driven roller 541*b* and fork 555*a* at the other end may hold the pin 552*b* and the swingable lever may be driven by the bell crank 552.

Also, the swingable lever 555 is provided with a stopper protrusion 555*c* which will be described later.

In addition, to the further supporting shaft 561 on the base board, freely rotatable stopper lever 562 is mounted so as to be energized clockwise of tension spring 563. Protrusion 562*a* on the stopper lever 562 is coupled to the notch of notched wheel 530 which is fitted to the spring clutch 527 from the outside of the spring clutch 527 as illustrated in FIG. 15 so that the notched wheel 530 is stopped in rotation. At the same time, the end 562*b* of the stopper lever 562 occupies a position within the operational region of pressure member 564 operated by the control system of the copying apparatus.

Arm 562*c* forming a portion of the stopper lever 562 occupies a position facing with a space to pin 542 of the driven roller 541*b*. The abovementioned pressure member 564 is operated by a solenoid or a cam in accordance with the signals given from the driving system for adjusting a photoreceptor drum for forming an image and the timing.

To the support shaft 561, separate from the stopper lever 562, a freely rotatable hook lever 571 is fitted and energized clockwise by torsion spring 572 suspended between the hook lever 571 and the stopper lever 562 and is stopped in motion by hitting the end 571*c* of the hook lever against stopper pin 573 on the base board. The hook 571*a* at the other end faces a position where the protrusion 555*c* of the swingable lever 555 can be stopped thereby, and the bend 571*b* formed at the other end occupies a position where the bend may be hit at the stopper lever 562 by the counterclockwise rotation of the stopper lever 562.

The paper feed unit of this example is so constructed as described above and now the function thereof will be described hereunder.

FIG. 13 illustrates a state where a sheet of recording paper is fed manually. In this state, semi-lunar roller 521 is at a standstill. Accordingly, when driving roller 541*a* of first paper feed rollers 541 is rotated counterclockwise by the driving system of a copying apparatus, recording paper P2 is pressed on by the driving roller 541*a* and driven roller 541*b* to second paper feed rollers 523, and the recording paper P2 is fed into a region for an image formation process upon adjusting the timing by the couterclockwise rotation of driving roller 523*a* started in motion by the control system of the copying apparatus.

On the other hand, as illustrated in FIG. 13, when switching a paper feed mode to the mode using a paper feed cassette, semi-lunar roller 521 is rotated counterclockwise by the driving system of the copying apparatus, and when the semi-lunar roller 521 rotates about a quarter turn, the circumferential surface of semi-lunar roller 521 comes into contact with the uppermost recording paper P1 of a stack loaded on a paper feed cassette 501 and the uppermost recording paper P1 is going to be transported thereby to the inside of the copying apparatus. At the same time the end 552*a* of bell crank 552 is lifted by point 522*a* of cam 522 and bell crank 552 is then rotated clockwise against tension spring 553. According to the rotation of pin 552*b* of bell crank 552, swingable lever 555 is forced to rotate counterclockwise and the end 555*a* thereof lifts pin 542 of driven roller 541*b* of first paper feed rollers 541. Resultantly, driven roller 541*b* is released from the pressure contact thereof with driving roller 541*a* to separate from each other. That is to say, when recording paper P1 is transported to feed from the described paper feed cassette 501, the copying apparatus becomes in no state to transport any of manually fed recording paper P2.

After protrusion 555*c* of the swingable lever 555 lifts up hook lever 571 in accordance with the counterclockwise rotation of the swingable lever 555, the protrusion 555*c* couples to the hook 571*a* of the hook lever 571 by the tension force of torsion spring 572 so as to be in the state shown in FIG. 14. Therefore, as shown in FIG. 14 even when semi-lunar roller 521 further rotates counterclockwise to complete a full turn, the driven roller 541*b* remains separated from driving roller 541*a*.

In other words, recording paper P2 which is to be fed manually remains interrupted in transport in the course of supplying recording paper P1 from paper feed cassette 501 to a copying apparatus. Therefore, recording paper in the manual feeding mode is never mingled with those in the automatic feeding mode even if trying a manual feeding carelessly. Therefore, any paper feed failure such as jamming does not occur at all.

Further, in this example, the state where the first paper feed rollers 541 are separated from each other remains as it is until second paper feed rollers 523 complete their operation.

Namely, in FIGS. 14 and 15, gear 526 rotated by driving system 524, 525 of a copying apparatus inclines to rotate together with spring clutch 527. However, it cannot rotate because protrusion 562*a* is coupled to notched wheel 530 put in from the outside of spring clutch 527. Therefore, a friction force is generated between the outer circumferential surface of the spring clutch 527 and the notched wheel 530, and accordingly the inner diameter of the spring clutch 527 is expanded, so as to make the gear 526 idle. Driving roller 523*a* is mounted to rotation shaft 529 connected through ring 528 to the spring clutch 527 and resultantly, the driving roller 523*a* is kept at a stand-still.

Next, pressure member 564 is actuated by a signal given from the control system of the copying apparatus by which the paper feed timing was adjusted, so as to press down the end 562*b* and then to rotate stopper lever 562 counterclockwise against tension spring 563, and at this moment the described protrusion 562*a* disengages from the notched wheel 530 to make the notched wheel free in motion, and resultantly any friction is not generated between the notched wheel and spring clutch 527. Accordingly, gear 526 and ring 528 are tightened to rotate respectively by spring clutch 527 so that driving roller 523*a* is rotated to feed recording paper P1 into a region for an image forming process.

At the same time, the described stopper lever 562 presses bend portion 571*b* of hook lever 571 so as to rotate the hook lever 571 counterclockwise against the tension of torsion spring 572 and thus, protrusion 555*c* of swingable lever 555 is released from the stopped state by the hook 571*a*. On the other hand, at this point of time, semi-lunar roller 521 and cam 522 completed a full turn and are at a standstill in the position indicated in FIG. 13. Accordingly, the swingable lever 555 is rotated clockwise by the motion of bell crank 552 which is rotated counterclockwise by tension spring 553.

Resultantly, driven roller 541*b* is to be descended by an elastic member (not shown), and, on the other hand, arm 562*c* of the stopper lever 562 occupies the place where it catches pin 542 of the driven roller 541*b*. Therefore, the driven roller 541*b* can not come into pressure contact with driving roller 541*a* even if it is going to descend. FIG. 14 illustrates the state mentioned above.

At the point of time when recording paper P1 is completely transported into the image formation processing region, the pressing action of the pressure member 564 is released by a signal given from the control system of the copying apparatus. At the same time, the stopper lever 562 is turned back clockwise again by tension spring 563 and is then stopped by protrusion 562*a* of notched wheel 530. On the other hand, arm 562*c* of stopper lever 562 also takes refuge clockwise to occupy the position indicated in FIG. 13, and is therefore described by the action of the elastic member and also comes into pressure contact with driving roller 541*a*. Resultantly, recording paper P2 may be fed manually with the rotation of the driving roller 541*a*.

In other words, according to this example, any manual paper feed is stopped in function from the time when starting in to transport recording paper P1 from paper feed cassette 501 by the rotation of semi-lunar roller 521 until the time when all the recording paper P1 are fed into the image formation processing region by the rotation of second paper feed rollers 523. Accordingly, no recording paper can be mingled at all with each other and any paper feed trouble can completely be prevented even if a manual paper feed is carelessly made in course of supplying recording paper P1 from the paper feed cassette 501.

In the two-partition type copying apparatuses described in the example of this invention, if the upper frame is carelessly opened in order to try to remedy a paper jamming or the like, there may be some instances where the slidable document table is moved by its own dead weight and it hits against a manual paper-feed tray to cause an irregularity in shape or a damage on both sides and sometimes a serious functional failure.

Figure 16:
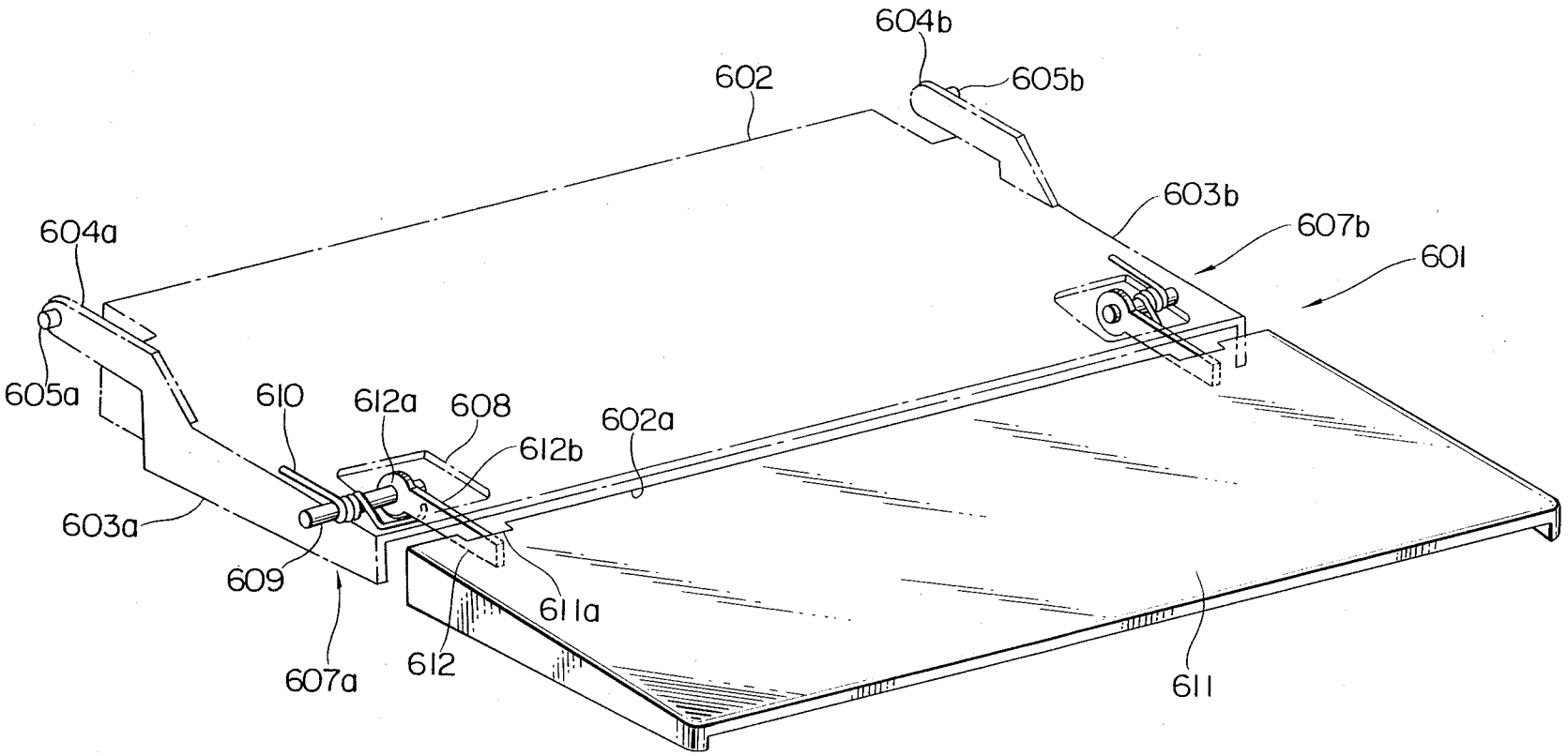
FIGS. 16 and 17 each illustrate the embodiment of the invention, respectively, in which a manual paper feed tray is incorporated in a copying apparatus, and, inter alia.
Figure 17:
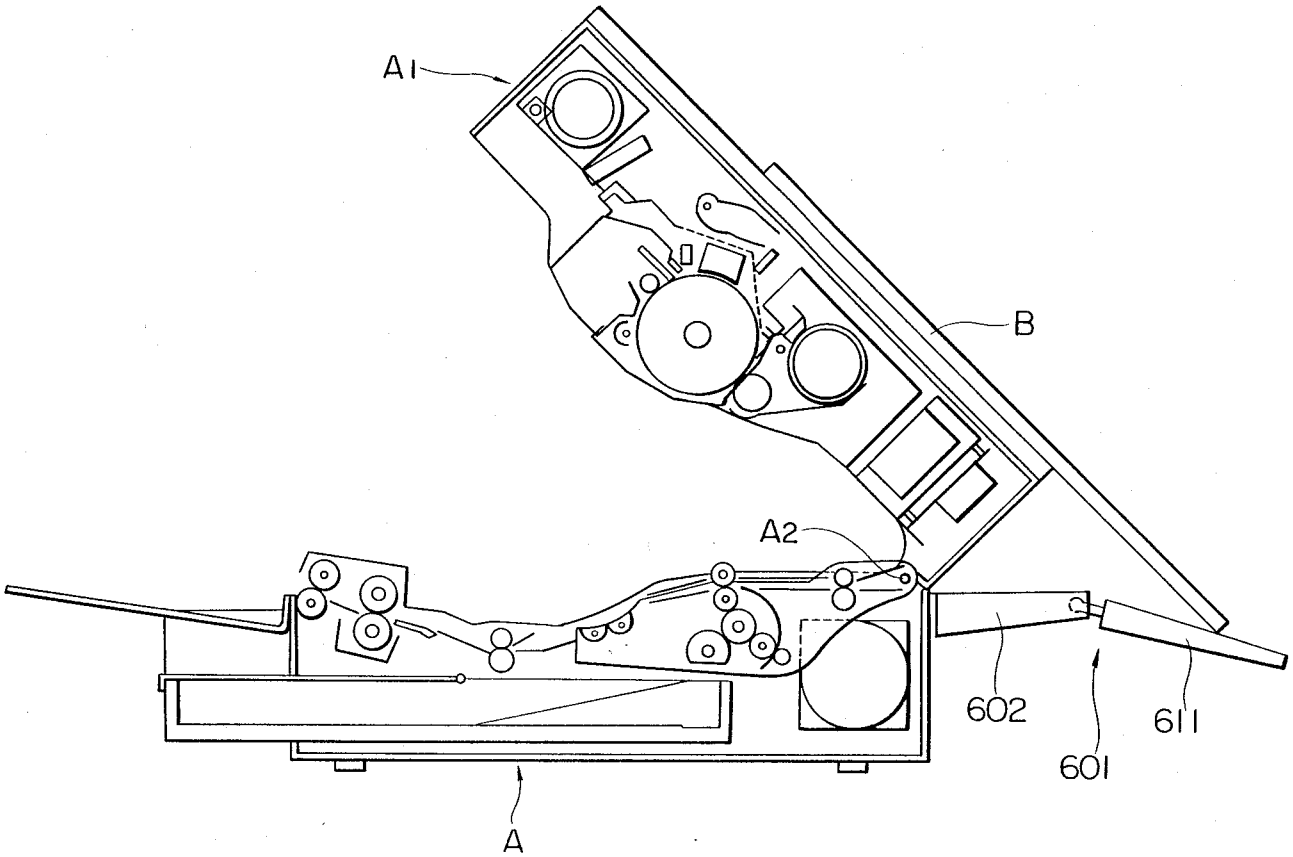

FIGS. 16 and 17 each illustrate an example of a manual paper-feed tray to be used in a copying apparatus of this invention.

FIG. 16 is a perspective view illustrating how to construct such a manual paper-feed tray, and FIG. 17 is a conceptual illustration of the effects obtainable when the manual paper-feed tray is used.

In these drawings, manual paper-feed tray 601 embodied in this example is so constructed as to be partitionable into lower frame A and upper frame $A_1$ and as to make both fixed part 602 which is to be mounted to lower frame A and movable part 611 which is rotatable only downward being supported by the fixed part 602 be on a plane by the action of an elastic member.

Arms 604*a* and 604*b* are provided respectively to the left and right side walls 603*a* and 603*b* of the fixed part 602, and lock pins 605*a* and 605*b* are fitted outward respectively to the tips of the arms.

And, by the both sides of the front edge of the fixed part 602, connection sections 607*a* and 607*b* are arranged respectively to connect with the movable part 611. In the connection section 607*a*, supporting shaft 609 is fitted up inside the side wall 603*a* through square hole 608 made on the upper surface of the fixed part 602. Further, in the square hole 608, the supporting shaft 609 is inserted in freely rotatable round-hole 612*a* of the end of hinged member 612 fixed to notch 611*a* of the movable part 611.

Further, to the base of the supporting shaft 609, torsion spring 610 is loosely put in and one end of the torsion spring 610 comes in pressure contact with the rear side of the fixed part 602 and the other end thereof couples to the lower edge of the hinged member 612. Accordingly, the movable part 611 is energized counterclockwise with respect to the fixed part 602 by the spring force of the torsion spring 610. However, upper edge 612*b* of the hinged member 612 is stopped in motion by rear side 602*a* of the fixed part 602. Therefore, the upper surface of movable part 611 is at a stand-still on a plane with the upper surface of the fixed part 602. Still further, connection section 607*b* is also so constructed as to be the same as the connection section 607*a*.

When using such constructed manual paper-feed tray 601 of the example to which the described lock pins 605*a* and 605*b* are coupled respectively to lower frame A of the copying apparatus body, if upper frame $A_1$ is opened carelessly about shaft $A_2$, as illustrated in FIG. 17, with the purpose of inspecting the inside of the mechanism or a paper feed failure, and the upper frame A is slanted sharply, the slidable document table B is then descended by its own dead weight and resultantly hits against the manual paper-feed tray 601. Even if causing such a result mentioned above, movable part 611 as a part of manual paper-feed tray 601 may elastically take refuge against the tension of torsion spring 610 as illustrated in the drawing. Therefore, the collision shock of document table B against manual paper-feed tray 601 may greatly be reduced. It is accordingly possible to perform the functions without any serious damage to the document table B as well as to manual paper-feed tray 601.

In this example, fixed part 602 of manual paper-feed tray 601 is fixed and the inlet of recording paper insertion guide is also adjusted and fixed. Therefore, any manual paper-feed operation is not disturbed at all even if such a movable part is provided.

In this example, the described connection sections 607*a* and 607*b* are provided respectively to the middle between fixed part 602 and movable part 611 of manual paper-feed tray 601. However, if a member having a function corresponding to the connection section 607*a* and 607*b* is provided to the main body of a copying apparatus, and is connected with a manual paper-feed tray in a body, so as to display the shock-absorbing function, it is then unnecessary to divide the manual paper-feed tray of the example into two but it is possible to enjoy the same effects with a simple sheet of plate member.

What is claimed is:

1. An image recording apparatus comprising:

an automatic paper-feed for feeding recording paper one after another from a stack of paper;

a manual paper-feed means for feeding recording paper manually; and a main body which comprises an upper frame coupled to a lower frame and which are relatively separable, wherein at least a part of said automatic paper-feed means and at least a part of said manual paper-feed means are arranged in one unit frame which is coupled to said rain body, one end of said unit frame being displaceably aranged relative to said main body when said upper frame and lower frame are relatively separated.

2. The image recording apparatus of claim 1, wherein said image recording apparatus is an electrostatic image recording apparatus, comprising:

means for forming a toner image on an electrostatic image carrier member;

means for transferring said toner image onto a sheet of a recording paper; and means for separating said paper with said image thereon from said electrostatic image carrier member; and said toner image transferring means and said recording paper separating means are coupled to said unit frame so as to be united together in a body.

3. the image recording apparatus of claim 2, wherein said unit frame is rotatably pivoted to a part of said main body.

4. The image recording apparatus of claim 3, wherein one end of said one unit frame is rotatably pivoted to a part of said lower frame of said main body.

5. An image recording apparatus of claim 3, wherein one end of said upper frame of said main body is rotatably coupled to one end of said lower frame by means of a shaft member; and one end of said unit frame is rotatably pivoted on said shaft member.

6. The image recording apparatus of claim 3, comprising means for biasing said unit frame toward said upper frame of said main body.

7. The image recording apparatus of claim 3, comprising means for biasing said unit frame toward said lower frame of said main body.

8. The image recording apparatus of claim 1, wherein said unit frame is rotatably pivotally mounted to a part of said main body.

9. The image recording apparatus of claim 8, wherein one end of said unit frame is rotatably pivotally mounted to a part of said lower frame of said main body.

10. The image recording apparatus of claim 8, wherein one end of said upper frame of said main body is rotatably coupled to one end of said lower frame by means of a shaft member; and one endof said unit frame is rotatably pivoted on said shaft member.

11. The image recording apparatus of claim 8, comprising means for biasing said unit frame toward said upper frame of said main body.

12. The image recording apparatus of claim 8, comprising means for biasing said unit frame toward said lower frame of said main body.

13. An image recording apparatus comprising:

an automatic paper-feed means for feeding recording paper one after another from a stack of paper;

a manual paper-feed means for feeding recording paper manually; and a main body which comprises an upper frame coupled to a lower frame, said upper and lower frames being relatively separable; and a unit frame coupled to at least one of said upper and lower frames, said unit frames comprising a part of said automatic paper feeding path and a part of said manual paper feeding path;

said unit frame being arranged so as to reveal at least said part of one of said automatic and manual paper feeding path when said upper frame is relatively separated from said lower frame; and said unit frame being displaceably arranged relative to at least one of said upper and lower frames when said upper frame is relatively separated from said lower frame so as to reveal at least said part of the other of said automatic and manual paper feeding path.

14. An image recording apparatus comprising:

a main body which comprises an upper frame coupled to a lower frame; and a unit frame comprising members defining a part of paper feeding passages, one end of said unit frame being displaceable coupled to said main body so as to be displaceable relative to at least one of said upper and lower frames when said upper frame and lower frame are relatively separated so as to selectively reveal at least a part of said paper feeding passages.

15. The image recording apparatus of claim 14, wherein said unit frame is rotatably mounted on a part of said main body.

16. The image recording apparatus of claim 14, wherein said image recording apparatus is an electrostatic image recording apparatus.

* * * * *